US007784533B1

(12) United States Patent
Hill

(10) Patent No.: US 7,784,533 B1
(45) Date of Patent: Aug. 31, 2010

(54) DOWNHOLE COMBUSTION UNIT AND PROCESS FOR TECF INJECTION INTO CARBONACEOUS PERMEABLE ZONES

(76) Inventor: Gilman A. Hill, 7128 S. Poplar La., Englewood, CO (US) 80112

( * ) Notice: Subject to any disclaimer, the term of this patent is extended or adjusted under 35 U.S.C. 154(b) by 0 days.

(21) Appl. No.: 12/317,980

(22) Filed: Dec. 31, 2008

Related U.S. Application Data

(63) Continuation of application No. 11/510,751, filed on Aug. 26, 2006, and a continuation-in-part of application No. 11/455,438, filed on Jun. 19, 2006.

(60) Provisional application No. 61/009,895, filed on Jan. 2, 2008.

(51) Int. Cl.
*E21B 43/24* (2006.01)
*E21B 36/00* (2006.01)

(52) U.S. Cl. ..... 166/59; 166/57; 166/256; 166/272.1; 166/272.3

(58) Field of Classification Search ..... 166/57, 166/58, 59, 256, 257, 259, 260, 272.1, 272.3
See application file for complete search history.

(56) References Cited

U.S. PATENT DOCUMENTS 3,254,721 A * 6/1966 Smith ..... 166/59
3,456,721 A * 7/1969 Smith ..... 166/59
4,136,737 A * 1/1979 Howard et al. ..... 166/250.15
4,452,309 A * 6/1984 Widmyer ..... 166/303
4,558,743 A * 12/1985 Ryan et al. ..... 166/303

* cited by examiner

*Primary Examiner*—Zakiya W Bates
*Assistant Examiner*—Angela M DiTrani
(74) *Attorney, Agent, or Firm*—Edwin H. Crabtree; Ramon L. Pizarro

(57) ABSTRACT

A downhole combustion unit for creating a high temperature, high pressure, thermal energy carrier fluid or TECF inside a drill hole, which can be injected into a hydrocarbon, permeable zone for mining and producing hydrocarbons therefrom. The combustion unit includes an outer well-bore casing cemented in place in the drill hole. An inner well-bore casing, with injection holes in a lower portion thereof is used as a combustion chamber. The inner casing is suspended inside the outer casing. The configuration of the concentric outer and inner casings provide an outer annulus therebetween for receiving a natural gas fuel and water mixture from a ground surface and circulated downwardly under pressure. Compressed air and steam are circulated down the inside of the inner casing. A glow plug may be attached to a lower end of an electric power cable and suspended inside the combustion chamber for better control in igniting the fuel and water mixture in the compressed air and steam mixture creating the TECF. The TECF is discharged out the bottom of the combustion unit and into a permeable, hydrocarbon zone.

13 Claims, 2 Drawing Sheets

DOWNHOLE COMBUSTION UNIT AND PROCESS FOR TECF INJECTION INTO CARBONACEOUS PERMEABLE ZONES

This a Continuation-In-Part patent application of a prior Utility Patent Application, titled "Integrated In-situ Retorting And Refining Of Oil Shale," filed on Jun. 19, 2006, Ser. No. 11/455,438, by Gilman A. Hill and Joseph A. Affholter, and a prior Continuation patent application of the Utility Patent Application, titled "Integrated In-situ Retorting and Refining of Heavy-Oil and Tar Sand Deposits", filed on Aug. 26, 2006, Ser. No. 11/510,751, by Gilman A. Hill and Joseph A. Affholter.

Also, the applicant/inventor claims the benefit of a Provisional Patent Application, titled "Downhole-Combustion Unit for TECF Injection", as filed on Jan. 2, 2008, Ser. No. 61/009,895, by Gilman A. Hill

BACKGROUND OF THE INVENTION (a) Field of the Invention

The subject downhole combustion unit and process provides for injecting a high-temperature, high-pressure, thermal-energy carrier fluid, called herein "TECF". The TECF is injected into either natural-occurring, permeable zones or propped-frac created permeable zones to create a desired, very large heating element in an underground surface area. This large, heating element surface area provides a means for economic, in-situ, pyrolysis, retorting, cracking and refining of a carbon-rich, geologic formation, which can be described as a fixed-bed, hydrocarbon formation, FBHF, or a fixed-bed, hydrocarbon deposit, FBHD. The FBHF and FBHD are defined as any carbon-rich geologic formation, including but not limited to those geologic formations containing deposits of kerogen, lignite/coal (including peat, lignite, brown coal, asphalt, bitumen, sub-bituminous coal, bituminous coal, anthracite coal), liquid petroleum, crude oil, depleted oil fields, heavy oil tar or gel-phase petroleum, and the like. The FBHF or FBHD of special, high-priority, economic development interest are the deposits of oil shale, tar sands, heavy-oil fields and lignite/coal beds.

(b) Discussion of Prior Art

Heretofore most designs for downhole combustion furnaces and processes are derived from surface operational models requiring clean exhaust gases with very low values of pollutants, such as unburned hydrocarbons, carbon monoxide and like gases. In the subject invention, the exhaust pollutants, from the downhole combustion chamber are commingled with other pollutants produced by the in-situ retorting process. Such pollutants must be extracted after being produced to the surface from the production wells. Consequently, the elaborate, pollutant-free combustion furnaces, with catalytic converters have no advantage, but many detriments for in-situ retorting applications.

None of the prior art patented methods and systems using compressed air and gas technology with boreholes have used a combustion unit as described herein for creating one or more large, thermal-energy heating elements in a permeable hydrocarbon zone. The heating elements extending outwardly from a well bore and conducting high volume rates of thermal-energy into a permeable, fixed-bed hydrocarbon deposit as discussed herein.

SUMMARY OF THE INVENTION

A primary objective of the subject combustion unit is to create TECF consisting of combustion exhaust gas at high temperatures and pressures downhole and inside a well borehole for injection into a permeable hydrocarbon formation or a propped, hydraulic fracture for in-situ retorting of carbonaceous deposits.

Another key object of the combustion unit is to provide a simple, low cost, system that requires very little research and development time. The unit is able to use and reuse unburned gases and water produced from the permeable hydrocarbon zone.

Yet another object of the invention is the injection well housing the combustion unit downhole can be easily converted into a spaced apart production well. Also, the production well can be easily converted back to an injection well with the combustion unit installed therein The subject downhole combustion unit includes an outer well-bore casing cemented in place in a drill hole. An inner well-bore casing, with injection holes in a lower portion thereof, is suspended inside the outer casing. The configuration of the concentric outer and inner casings provide an outer annulus therebetween for receiving a natural gas fuel and water mixture from a ground surface and circulated downwardly under pressure. Compressed air and steam are circulated down the inside of the inner casing. A lower portion of the inner casing includes a plurality of injection holes for receiving the fuel and mixture inside the inner casing and mixing with the compressed air and steam. The lower portion of the inner casing with injection holes provides for a combustion chamber. A glow plug may be attached to a lower end of a power cable suspended inside the combustion chamber for more positive control in igniting the mixtures of fuel, water compressed air and steam and creating a high temperature, high pressure TECF. Also, it should be mentioned that the mixtures in the combustion chamber can self ignite under high pressure and temperature and without the need of a glow plug or other ignition means. The TECF is discharged out the bottom of the combustion unit and into a permeable, hydrocarbon zone.

These and other objects of the present invention will become apparent to those familiar with in-situ retorting and refining of hydrocarbons in underground deposits when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
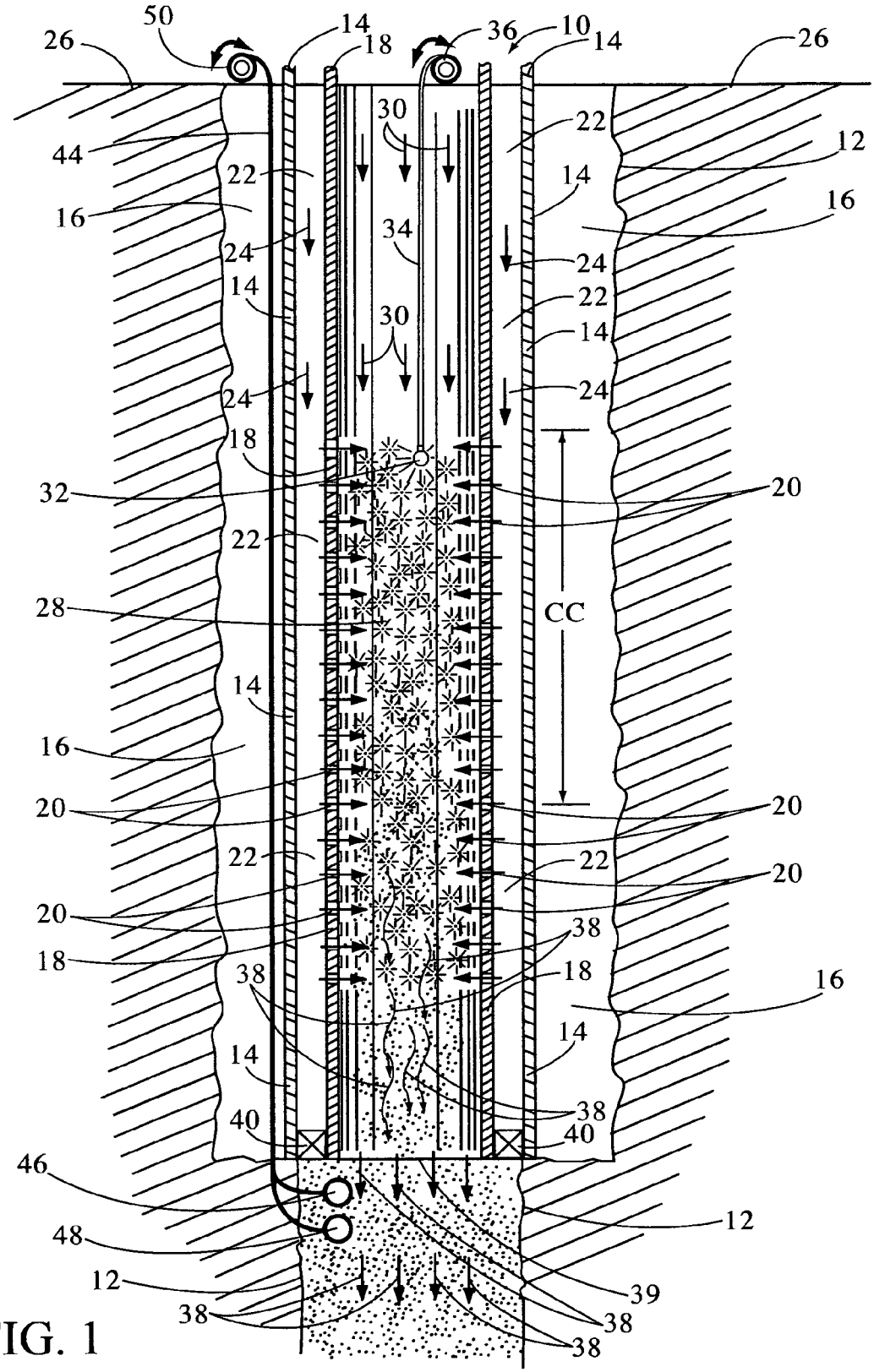
FIG. 1 illustrates a cross-sectional view of the subject downhole-combustion unit installed in a drill hole. A well-bore outer casing is cemented in place next to the drill hole. A well-bore inner casing, with injection holes in a portion thereof, is suspended inside the well-bore outer casing.

In FIG. 1, a cross-sectional view of the subject downhole-combustion unit, having general reference numeral 10, is shown installed in a drill hole 12. A well-bore outer casing 14 is held in place next to the drill hole 12 using cement 16. A well-bore inner casing 18, with injection holes 20 in a lower portion thereof, is suspended inside the outer casing 14. The configuration of the concentric casing 14 and 18 provide an outer annulus 22 for receiving a natural gas fuel and water mixture, indicated by arrows 24, therebetween from a ground surface 26 and circulated downwardly under pressure.

The outer casing 14 typically has, but not limited to, a 13⅜ inch OD and 12.347 inch ID, 72 lb/ft casing, such as N-80 or C-75 grade, standard, oil field steel casing. Also, the suspended inner casing 18 typically has, but not limited to, a 9⅝ inch OD and 8.835 inch ID, 40 lb/ft casing, such as N-80, C-75, or J-55 grade, standard, oil field steel casing. Using this size of oil field casing, the annulus area is 0.3262 square feet per foot length and the annulus volume is 0.3262 cubic feet per foot length.

The natural gas fuel and water mixture 24 is circulated down the annulus 22 and then through the injection holes 20 into a combustion chamber 28 and shown in the drawing as "CC". The water volume in the mixture 24 can be increased on decreased to control the exhaust output temperature at the bottom of the chamber 28. Inside the combustion chamber 28, the fuel and water mixture 24 is mixed with a compressed air and steam mixture, indicated by arrows 30. The air and steam mixture 30 is introduced from the ground surface 26 and circulated under pressure down the inside of the inner casing 18.

The area and volume inside the 8.835 inch ID casing 18 is 0.4257 square feet per foot length and 0.4257 cubic feet per foot length. The air and steam mixture 30, in a range of 400 to 800 degrees F., will flow inside the inner casing 18, down to the combustion chamber 28, where it's mixed with the fuel and water mixture 30 received through the injection holes 20. The air and steam mixture 30 can be a normal 20% oxygen-air mixture or can be an oxygen-enriched air, such as 40 to 60% oxygen. Also, additional water mist or foam can be added into the air and steam mixture 30 if needed to control the combustion exhaust temperature at a desired value at the bottom of the combustion chamber 28.

The ignition of the natural gas fuel and water mixture 24 and the air and steam mixture 30 at the top of the combustion chamber 28 and inside the inner casing 18, as indicated by star bursts in the drawings, can be initiated by the high temperature of the fluid mixtures or by using an electric spark or an electric-heated glow plug 32 shown in the drawings. The glow plug 32 is attached to one end of a conventional, retrievable, electric line, power cable 34 lowered into the top of the combustion chamber 28 from the ground surface 26 using a wireline spool 36.

When the mixture is ignited, the heated, compressed air will burn the additional fuel injected from the annulus 14 into the combustion chamber 28 through the injection holes 20. The combustion chamber 28 or "CC" can be a single 30 foot to 40 foot pipe joint using a 9⅝ inch oil-field casing. The overall length of the outer and inner casings 14 and 18 can vary from a few hundred feet to a few thousand feet depending on the depth of the underground, permeable zone to mined in-situ using the TFCF for extracting hydrocarbons therefrom.

Figure 2:
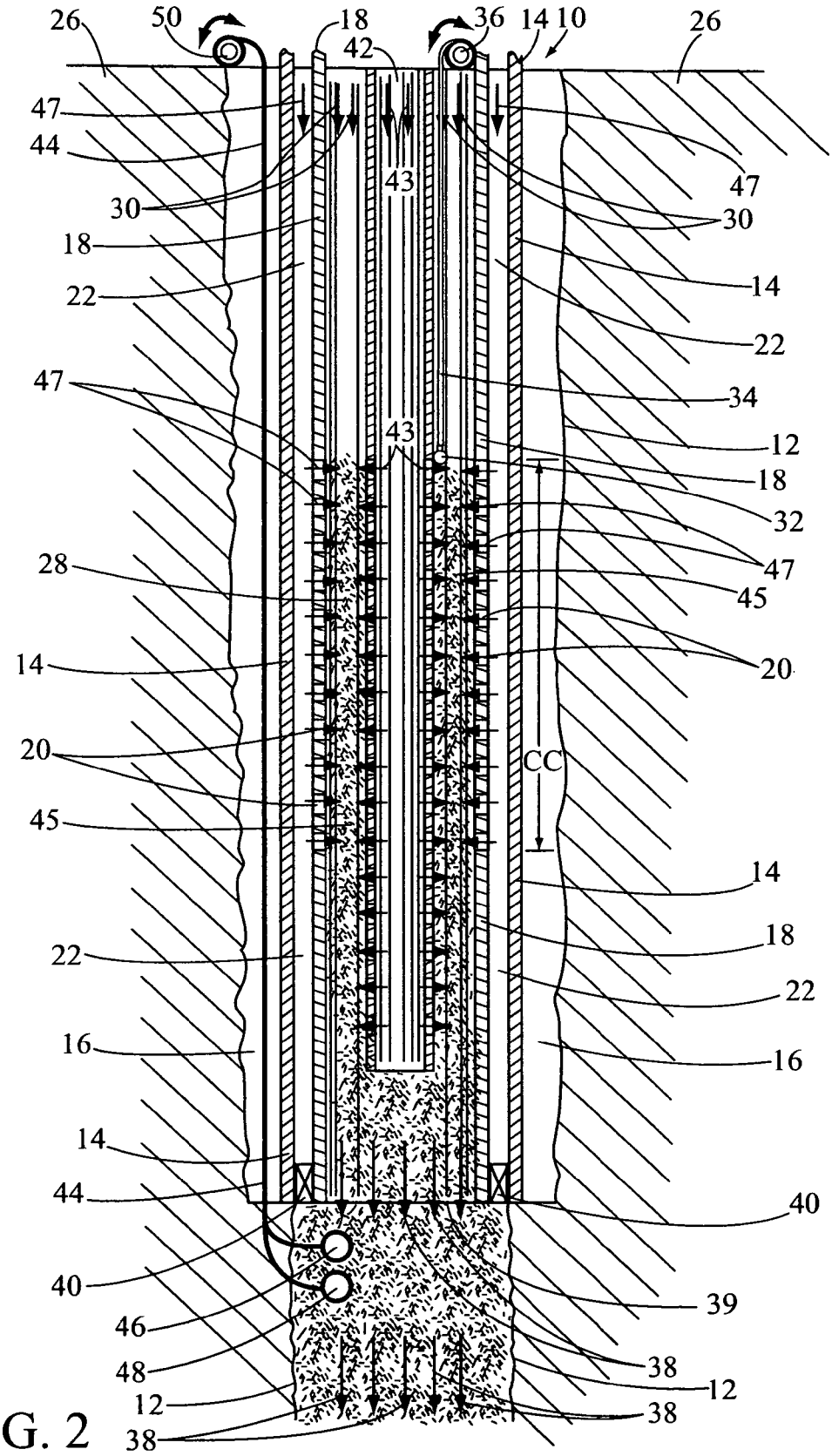
FIG. 2 illustrates a cross-sectional view of another embodiment of the downhole-combustion unit installed in the drill hole. In this example, a separate natural gas tubing is inserted inside the inner casing. The injection of water is separated from the gas fuel prior to combustion inside a combustion camber next to the injection holes inside the inner casing.

Shown in both FIGS. 1 and 2 and in an upper portion of the combustion chamber 28, the fuel and water mixture 24 is very lean and becomes richer and hotter further downstream in the lower portion of the chamber. The drawings illustrate increase density in the lower portion of the chamber 28 of the burned mixture, shown as star bursts, and unburned mixture, shown as dots. If desired, extra natural gas fuel can be injected to provide for high-temperature, unburned methane, as an important constituent of the TECF. Such unburned methane in the injected TECF into the permeable hydrocarbon zone can greatly facilitate the retorting of, for example, kerogen in oil shale deposits. The TECF is shown as arrows 38 moving downwardly and out an open bottom of the inner casing 18. The open bottom of the inner casing 18 would be typically disposed next to an open, un-cemented, lower portion of the drill hole and next to a permeable hydrocarbon zone for introduction of the TECF therein.

The bottom of the inner casing 18 can be seated into a tapered joint or a screw-in joint 40 in the outer casing 12 to permit the pressuring up of the fuel and water mixture 24 in the outer annulus 22 to control the mixture's injection rate into the combustion chamber 28. If a leak develops in the joint, fine-grained sand may be circulated down the annulus 22 and pack the bottom of the annulus, thereby reducing the leakage to a negligible value.

When the injection process of the mixtures 24 and 30 is completed in the combustion chamber 28, the power cable 34 on the wireline spool 36 can be retracted. When the cable is fully removed, the drill hole 12 is ready for production of hydrocarbon products retorted from the permeable hydrocarbon zone. A simple conversion of the injection well with downhole combustion unit 10, shown in FIGS. 1 and 2, to a production well eliminates the need of drilling a separate drill hole for production at this well site. For example, at each well site, two convertible wells can be drilled. For a selected time period, well "A" can be used as an injection well, as shown in the drawings, and a well "B" can be used as a production well. Then for a next selected time period, well "B" can be converted to an injection well and well "A" can become the production well.

In FIG. 2, an another embodiment of the downhole-combustion unit 10 is shown. This embodiment of the invention is used in the event the injection of water into the combustion chamber 28 needs to be separately controlled from the fuel introduced into the unit 10. In this example, the outer casing 14 is the same, but the inner casing 18 is changed to a 10¾ inch OD and a 9.85 inch ID, 51 lb/ft casing. A 2⅞ inch OD gas fuel tubing 42 is inserted inside the inner casing 18 for circulating natural gas fuel, shown as arrows 43, into the combustion chamber 28.

In this example, the outer annulus 22 has an area of 0.2012 square feet per foot length, between the outer casing 14 and the inner casing 18. The annulus 22 is filled with water shown as arrows 47, at a desired pressure to control it's injection rate into the combustion chamber 28. The water circulation is shown as arrows 47. In this embodiment, the combustion chamber 28 is now between the inner casing 18 and the gas fuel tubing 42 and having an inner annulus 45. The inner annulus 45 has an area of 0.4841 square feet per foot length The gas fuel tubing 42 has an area of 0.02783 square feet per foot length, which is filled with natural gas for combustion inside the combustion chamber 28. The mixture of gas fuel, water and compressed air may be ignited, as mentioned above, using the suspended glow plug 32 on the power cable 34.

Also shown in FIGS. 1 and 2 and disposed next to the outer casing 14 is a pressure and temperature cable 44 having a lower end attached to a temperature gauge 46 and a pressure gauge 48. The two gauges 46 and 48 are positioned at the bottom of the unit 10 and disposed in the path of the exiting TECF 38 from the combustion unit 10. The gauges are used to monitor the temperature and pressure of the TECF as it's introduced into the permeable, hydrocarbon zone or a fractured propped permeable zone. An upper end of the cable 44 is attached to a cable reel 50 on the ground surface 26.

The water 47 is injected down the outer annulus 22 and into the combustion chamber 28 for controlling the exhaust temperature of the TECF in the bottom of the unit 10. The exhaust temperature of the TECF is typically in a range of 700 to 1400 degrees F. In oil shale zones, the formation water has about 1200 to 1800 ppm of total dissolved solids or salts. The dissolved salts are predominately a highly soluble nahcolite mineral ($NaHCO_3$), thus creating a brackish-water solution. As these formation waters are injected into the combustion chamber 28, the water 47 will be evaporated leaving a finely powdered nahcolite mineral dispersed in the exhaust gas, which is carried off with the TECF into the porous, permeable zone to be mined in-situ.

The volume of the powdered, soluble mineral in the water 47 is too small to create significant permeability loss in the porous formation or propped hydraulic fracture. However, if the porous zone or propped fracture's permeability is significantly reduced, water may be injected to dissolve the nahcolite mineral deposit from near the well bore to re-establish the original permeability. The produced formation water, evaporated in the combustion chamber 28, will be condensed as distilled water in the ground surface processing equipment downstream form the producing well. The condensed, distilled water can be used as clean water for injection into multistage, wet-air compressors to create compressed air to be injected into the injection well or injection wells.

The following specifications for the downhole combustion unit 10 are now summarized for each injection well in operation. It should be kept in mind that these specifications are typical and are estimates only. They are:

1. Combustion rate=4 billion Btu/d/well=167 million Btu/hr/well
2, Output pressure=0.85 psi per foot of depth.
a) at 700 feet of depth=600 psi
b) at 900 feet of depth=760 psi
c) at 1100 feet of depth=950 psi
d) at 1300 feet of depth=1100 psi
e) at 1500 feet of depth=1275 psi
3. Output temperature=700 degrees F. to 1400 degrees F.
4. Inlet temperature=400 degrees F. to 800 degrees F.

| 5. Compressed-air volume | @ 15 psi | @ 600 psi |
|---|---|---|
| a) standard air @ 20% $O_2$ = | 28,000 scfm | 700 cfm |
| b) standard air @ 40% $O_2$ = | 14,000 scfm | 350 cfm |
| c) standard air @ 60% $O_2$ = | 9330 scfm | 233 cfm |

6. Water injection rate=as needed to control output pressure.
7. Natural-gas fuel volume @ 1000 Btu/cu/ft to produce 4 billion Btu/d/well=4 mmcf/d/well.
8. Combustion-exhaust quality: The downhole combustion chamber exhaust is injected into the in-situ, retorting formation, where it is commingled with the retorted hydrocarbon products, all of which are later produced to the surface for extraction from the product line. Combustion should be stoichiometric, plus or minus 10% fuel mixture.
a) NOx=reasonably low, less than 25 ppm.
b) $CO_2$=all values acceptable.
c) Unburned hydrocarbons+all values acceptable.
9. Downhole combustion unit manufacturing rate per year.

| | Minimum rate | Crisis-accelerated rate |
|---|---|---|
| 1st Year | 30/year | 400/year |
| 2nd Year | 200/year | 1400/year |
| 3rd Year | 800/year | 2700/year |
| 4th Year | 2000/year | 3500/year |
| 5th Year | 3000/year | 5000/year (for 0.4 years) |
| 6th Year | 4000/year | — |

Accumulative volume 10,000/6 years 10,000.4.4 years

To accomplish the above production objectives, the subject downhole combustion unit 10 should be the simplest design, preferably with the ability to easily change form an injection-combustion well function to a product production well function, without the necessity of drilling a second production well. Sinch the exhaust from the combustion unit 10 will be commingled with the in-situ, retorted hydrocarbon products, it is not necessary to minimize the $CO_2$ unburned hydrocarbon components and unused oxygen, which will be commingled with the other retorted hydrocarbon products. The primary requirements of the subject invention are to deliver into the retorting underground formation about 4 billion Btu/d (i.e., 167 million Btu/hour) at 700 to 1400 degrees F. and at a desired formation injection pressure, (i.e., about 0.85 psi/feet of depth).

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A downhole-combustion unit, disposed in a drill hole and below a ground surface, the unit adapted for receiving a fuel and water mixture and a compressed air and steam mixture, the two mixtures when ignited creating a high pressure, high temperature, thermal energy carder fluid (TECF) therein and injecting the TECF into a hydrocarbon permeable zone next to a lower portion of the drill hole, the unit comprising:

a well-bore outer casing, the outer casing cemented in place in the drill hole;

a well-bore inner casing, the inner casing disposed inside the outer casing and suspended from the ground surface, the inner casing having injection holes in a lower portion thereof; the inside of the lower portion of the inner casing with injection holes providing a combustion chamber, the inner casing adapted for receiving the air and steam mixture under pressure therein;

an outer annulus disposed between the outer casing and the inner casing, the annulus adapted for receiving the fuel and water mixture under pressure therein, the fuel and water mixture received through the injection holes into the combustion chamber; and ignition means suspended from the ground surface and inside the inner casing for igniting the fuel and water mixture and the air and steam mixture inside the combustion chamber thereby creating the TECF, the TECF exiting out an open bottom of the inner casing and into the permeable zone.

2. The unit as described in claim 1 wherein the ignition means is a glow plug attached to a lower end of a power cable suspended inside the combustion chamber.

3. The unit as described in claim 1 wherein the combustion chamber has a length in a range of 30 to 40 feet.

4. The unit as described in claim 1 further including an annulus seal disposed at the bottom of the outer annulus and between the outer casing and the inner casing for pressuring up the fuel and water mixture and controlling the mixture's injection rate into the combustion chamber.

5. The unit as described in claim 1 wherein the outer casing has a 13⅜ inch OD and a 12.347 inch ID and is made of a standard grade, oil field steel casing.

6. The unit as described in claim 5 wherein the inner casing has a 9⅝ inch OD and a 8.835 inch ID and is made of a standard grade, oil field steel casing.

7. The unit as described in claim 1 wherein the air and steam mixture received in inside the combustion unit is in a range of 400 to 800 degrees F.

8. A process for creating a high pressure, high temperature, thermal energy carrier fluid (TECF) in a downhole-combustion unit disposed in a drill hole and below a ground surface and injecting the TECF into a hydrocarbon permeable zone next to a lower portion of the drill hole, the steps comprising:

installing a well-bore outer casing in the drill hole and cementing it in place in the drill hole;

installing a well-bore inner casing inside the outer casing and suspending it from the ground surface, the inner casing having injection holes in a lower portion thereof, the inside of the lower portion of the inner casing with injection holes providing a combustion chamber, circulating an air and steam mixture under pressure inside the inner casing and into the combustion chamber;

circulating a fuel and water mixture under pressure inside an outer annulus disposed between the outer casing and the inner casing and circulating a fuel and water mixture through the injection holes into the combustion chamber;

igniting the fuel and water mixture and the air and steam mixture inside the combustion chamber and creating the TECF; and discharging the TECF out an open bottom of the inner casing and into the permeable zone.

9. The process as described in claim 8 wherein a glow plug attached to a lower end of a power cable suspended inside the combustion chamber is used for igniting the fuel and water mixture and the air and steam mixture.

10. The process as described in claim 8 wherein the combustion chamber has a length in a range of 30 to 40 feet.

11. The process as described in claim 8 further including a step of installing an annulus seal at the bottom of the outer annulus and between the outer casing and the inner casing for pressuring up the fuel and water mixture and controlling the mixture's injection rate into the combustion chamber.

12. The process as described in claim 8 further including the step of increasing the oxygen content in the fuel and air mixture in a range of 40 to 60 percent oxygen.

13. The process as described in claim 8 further including the step of installing temperature and pressure gauges at the bottom of the inner casing for monitoring the exhaust temperature and pressure of the TECF exiting the bottom of the inner casing.

* * * * *

UNITED STATES PATENT AND TRADEMARK OFFICE

CERTIFICATE OF CORRECTION

PATENT NO. : 7,784,533 B1
APPLICATION NO. : 12/317980
DATED : August 31, 2010
INVENTOR(S) : Hill It is certified that error appears in the above-identified patent and that said Letters Patent is hereby corrected as shown below:

On the title page, item (76) should read as follows:

Joseph A. Affholter
Gilman A. Hill

Signed and Sealed this
Fifth Day of April, 2011

David J. Kappos

David J. Kappos
*Director of the United States Patent and Trademark Office*